US006179763B1

(12) United States Patent
Phillips, III

(10) Patent No.: US 6,179,763 B1
(45) Date of Patent: Jan. 30, 2001

(54) BOX MAKING MACHINES AND METHOD OF RETROFITTING

(75) Inventor: Daniel Cunnington Phillips, III, Abingdon, MD (US)

(73) Assignee: Sun Automation Inc., Sparks, MD (US)

( * ) Notice: Under 35 U.S.C. 154(b), the term of this patent shall be extended for 0 days.

(21) Appl. No.: 09/265,816

(22) Filed: Mar. 10, 1999

Related U.S. Application Data

(60) Provisional application No. 60/116,849, filed on Jan. 22, 1999.

(51) Int. Cl.[7] ..... B31B 1/25

(52) U.S. Cl. ..... 493/60; 493/66; 493/71; 493/64; 493/55; 493/115; 493/471

(58) Field of Search ..... 493/60, 66, 71, 493/115, 64, 55, 362, 361, 473, 471, 477; 53/201, 167; 101/232; 271/112, 194, 196

(56) References Cited

U.S. PATENT DOCUMENTS

| | | | | |
|---|---|---|---|---|
| 4,520,612 | * | 6/1985 | Muller | 53/201 |
| 4,604,083 | * | 8/1986 | Barny et al. | 493/34 |
| 4,618,342 | * | 10/1986 | Borel | 493/477 |
| 4,968,292 | * | 11/1990 | Takeda | 493/477 |
| 5,004,221 | * | 4/1991 | Stark | 271/194 |
| 5,163,891 | * | 11/1992 | Goldsborough et al. | 493/321 |
| 5,599,363 | * | 2/1997 | Percy | 55/352 |
| 5,657,529 | * | 8/1997 | Bohn et al. | 493/477 |
| 5,954,863 | * | 9/1999 | Loveless et al. | 96/321 |

* cited by examiner

*Primary Examiner*—Stephen F. Gerrity
*Assistant Examiner*—Sam Tawfik
(74) *Attorney, Agent, or Firm*—William E. Mouzavires

(57) ABSTRACT

An existing box-making machine is retrofitted by first removing the pull rolls and impression cylinder and other associated parts and cross-ties. However, the heavy duty side frames and drums, including the print cylinder are left intact in the box-making machine. A vacuum transfer machine is then inserted in the box-making machine and mounted to the existing frame to replace the pull rolls that were removed. The vacuum transfer machine includes a hood enclosure having an impression cylinder for printing, and transport rolls on opposite sides of the impression cylinder for conveying the corrugated boards through the impression and print cylinders and to the die cutter. The boards are held against the transport rolls and the impression cylinder by vacuum generated in a vacuum chamber in the hood which also contains the transport rolls and the impression cylinder. The vacuum chamber contains a plurality of vacuum dampers for controlling the vacuum area in accordance with the size of the boards being processed. For creating vacuum in the vacuum chamber, high performance "volume blowers" are included on the top of the vacuum transfer machine. Exhaust air from the vacuum chamber is dispersed through filters located adjacent to the blowers. The hood is suspended from a cross-tie which is part of the vacuum transfer machine and adapted to be mounted to the opposite side frames of the existing box-making machines. The cross-tie has a vertically adjustable portion for adjusting the nip of the impression cylinder.

20 Claims, 9 Drawing Sheets

84
73
70
42
83
80
6
6
82
70
80
84
82

BOX MAKING MACHINES AND METHOD OF RETROFITTING

RELATED APPLICATION

This application is a complete application based on my pending provisional patent application Ser. No. 60/116,849 filed Jan. 22, 1999 and entitled BOX MAKING MACHINES AND METHOD OF RETROFITTING. The filing date priority of my aforementioned provisional application is hereby claimed for the subject application.

OBJECTS OF THE PRESENT INVENTION

The present invention generally relates to box-making or finishing machines and more particularly to novel and improved apparatus including a vacuum transfer machine for use in box-making machines. The present invention also relates to a novel method and apparatus for retrofitting a box-making machine with a new vacuum transfer machine and impression cylinder.

An object of the present invention is to provide a novel and improved vacuum transfer machine for use in a box-making machine. Included herein is such a vacuum transfer machine that is highly suited for retrofitting into existing box-making machines.

Another object of the present invention is to provide a novel and improved vacuum transfer machine that incorporates an impression cylinder for the print operation. Included herein is such a machine that incorporates a novel method and apparatus for setting and adjusting the nip of the impression cylinder.

Another object of the present invention is to provide a novel and improved method and apparatus for retrofitting box-making or finishing machines with a vacuum transfer mechanism. Included herein is such a method and apparatus that retrofits vacuum transfer apparatus together with a print impression cylinder as a unit insertable into the box making machine.

SUMMARY OF PREFERRED EMBODIMENT OF THE PRESENT INVENTION

An existing box-making machine is retrofitted by first removing the pull rolls and impression cylinder and other structures, for example, the existing elevating adjustment mechanism, permanent mesh arrangement, associated power train gears, associated rolls and shafts, and associated cross-ties. However the heavy duty frames and drums, including the print cylinder are left intact in the box-making machine.

A vacuum transfer machine is then inserted in the box-making machine and mounted to the existing frame to replace the pull rolls or other transfer apparatus that was removed.

Included in the vacuum transfer machine is an impression cylinder for printing, and transport rolls or wheels preferably on opposite sides of the impression cylinder for conveying the corrugated board or blank through the impression and print cylinders and to the die cutter. The boards are held against the transport rolls and the impression cylinder by vacuum generated in a vacuum chamber such as a hood which also contains the transport rolls and the impression cylinder. The vacuum chamber contains a plurality of vacuum doors or dampers for controlling the vacuum area in accordance with the size of the boards or blanks to be processed.

For creating the vacuum in the vacuum chamber, high performance "volume blowers" rather than conventional pressure blowers are used. The blowers are included on the vacuum transfer machine. Exhaust air from the vacuum chamber is dispersed through filters over a wide area so that the exhaust is clean and free of strong air currents.

DRAWINGS

Other objects of the present invention will become apparent from the following more detailed description of the present invention in conjunction with the attached drawings in which..

DETAILED DESCRIPTION

Figure 1:
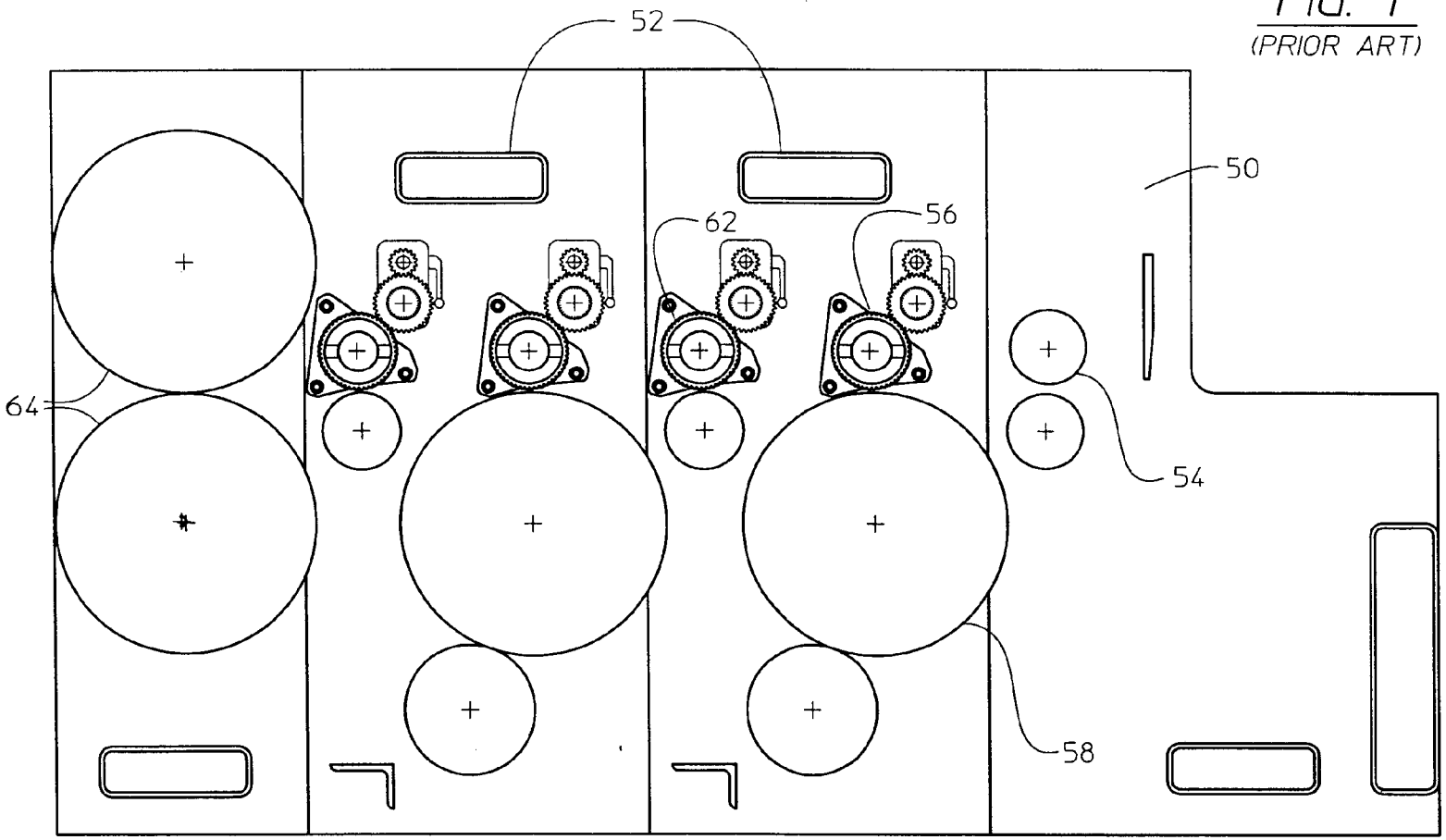
FIG. 1 (PRIOR ART)
FIG. 1 is a side elevational view of a box-making machine or finishing machine of the prior art.

Referring to FIG. 1, a box-making or finishing machine of the prior art is shown including fixed side frames 50 on opposite sides thereof and cross-ties 52 fixed to and extending there between. Also included are pinch or feed rolls 54 for feeding corrugated boards or blanks to a first printing unit including an impression cylinder 56 and a print cylinder 58 which after printing the board feeds it to pull rolls 62 which in turn feed the board to a second printing unit similar to that just described at 56 and 58. The latter feeds the board to pull rolls 62 which in turn feeds the board to die cutters 64.

Figure 2:
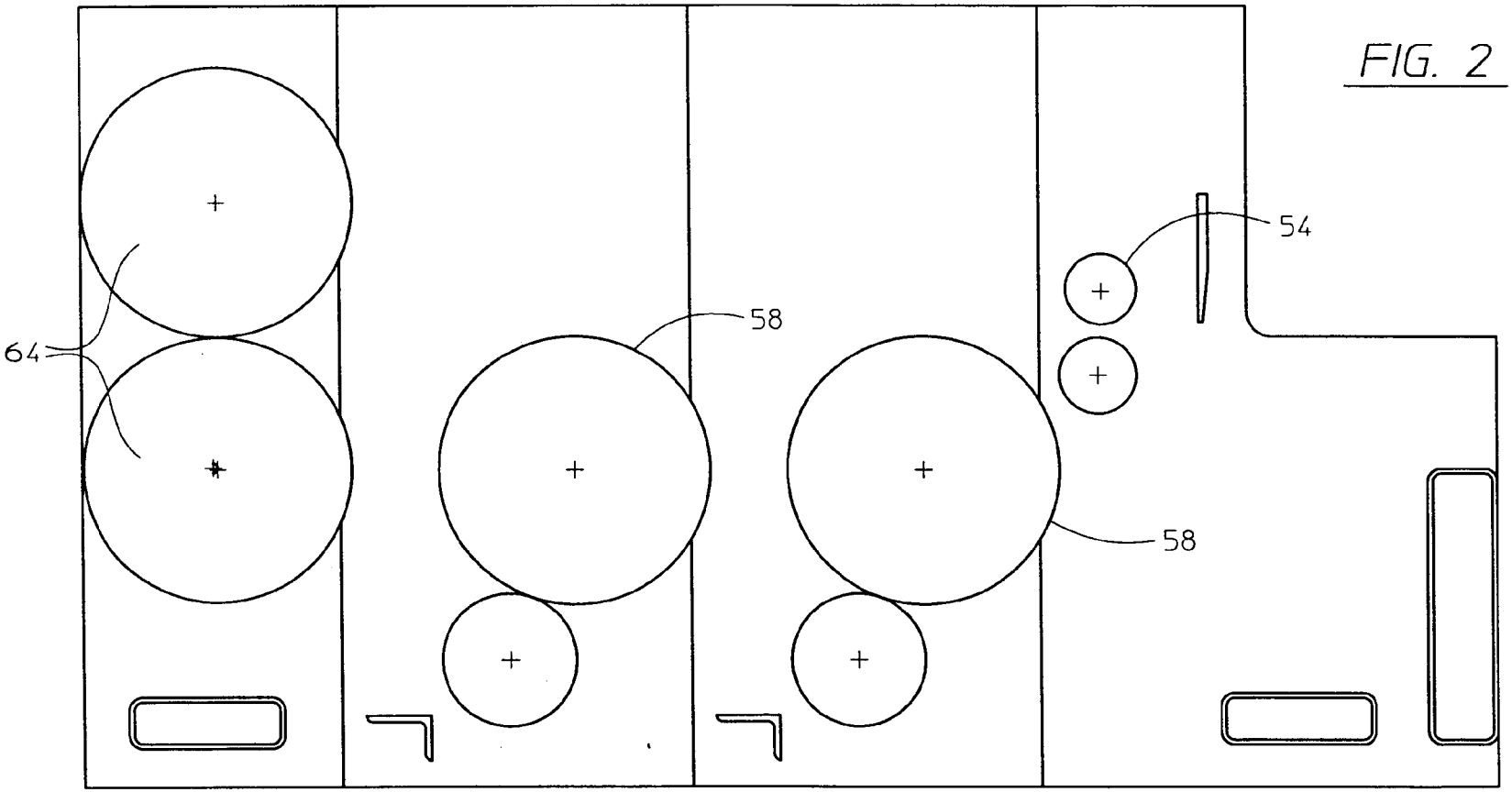
FIG. 2 is a diagramatic view of the machine of FIG. 1 but with parts removed in accordance with a retrofitting method of the present invention.
Figure 3:
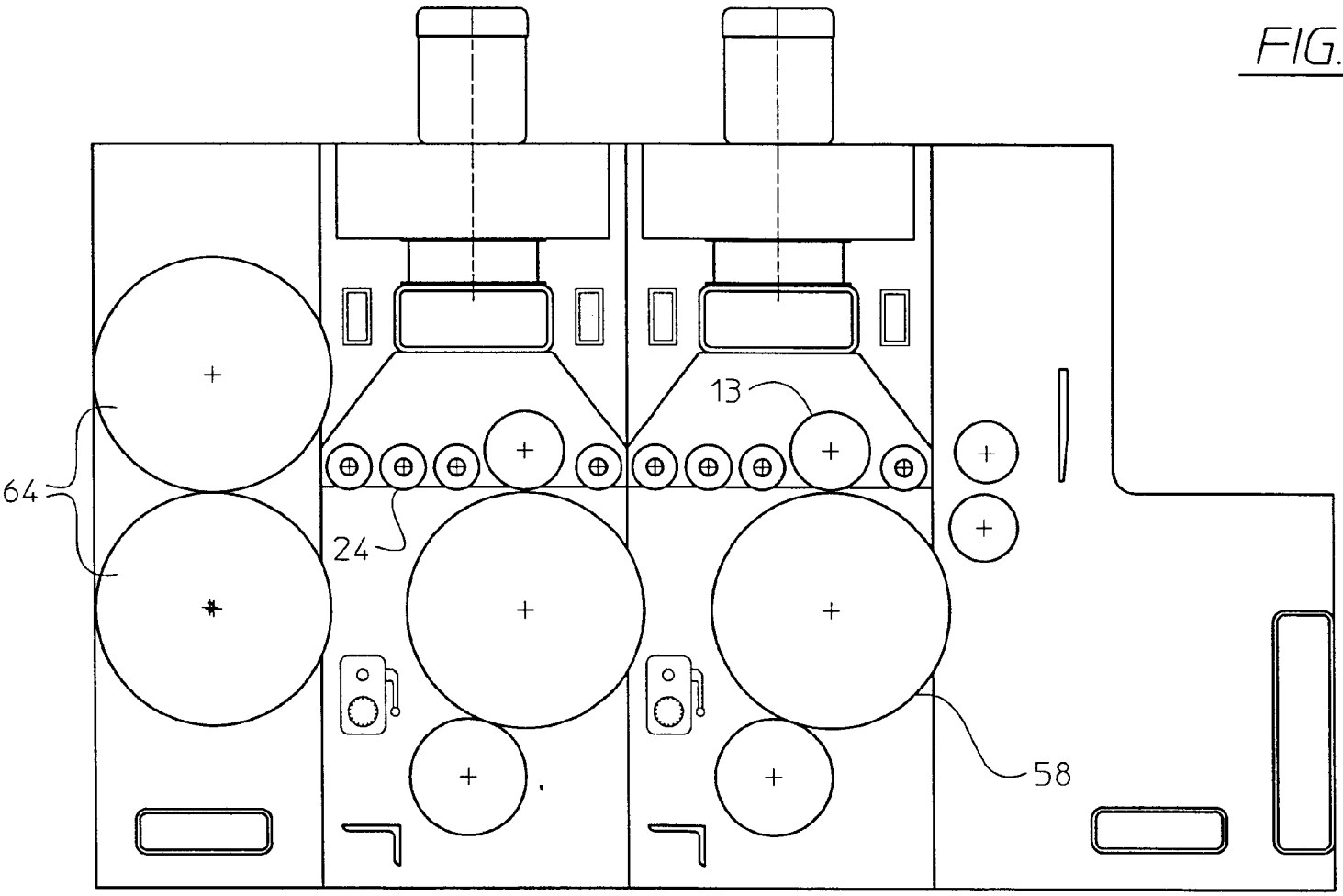
FIG. 3 is a side elevational view of the machine of FIG. 1 but after it has been retrofitted in accordance with the present invention.

In accordance with one of the present inventions, when it is desired to improve or upgrade the pull rolls 62, the pull rolls 62 are removed together with associated structure or parts. In addition the cross-ties 52 and the impression cylinders 56 are removed. Other parts that are removed may include, for example, elevation adjustment mechanisms, permanent mesh arrangement, associated power train gears, rolls and shafts. Note however that the heavy duty frames 50 and drums including the print cylinders 58 are left intact as are the die cutter drums 64. FIG. 2 shows the machine after the above described parts are removed.

Figures 4, 5:
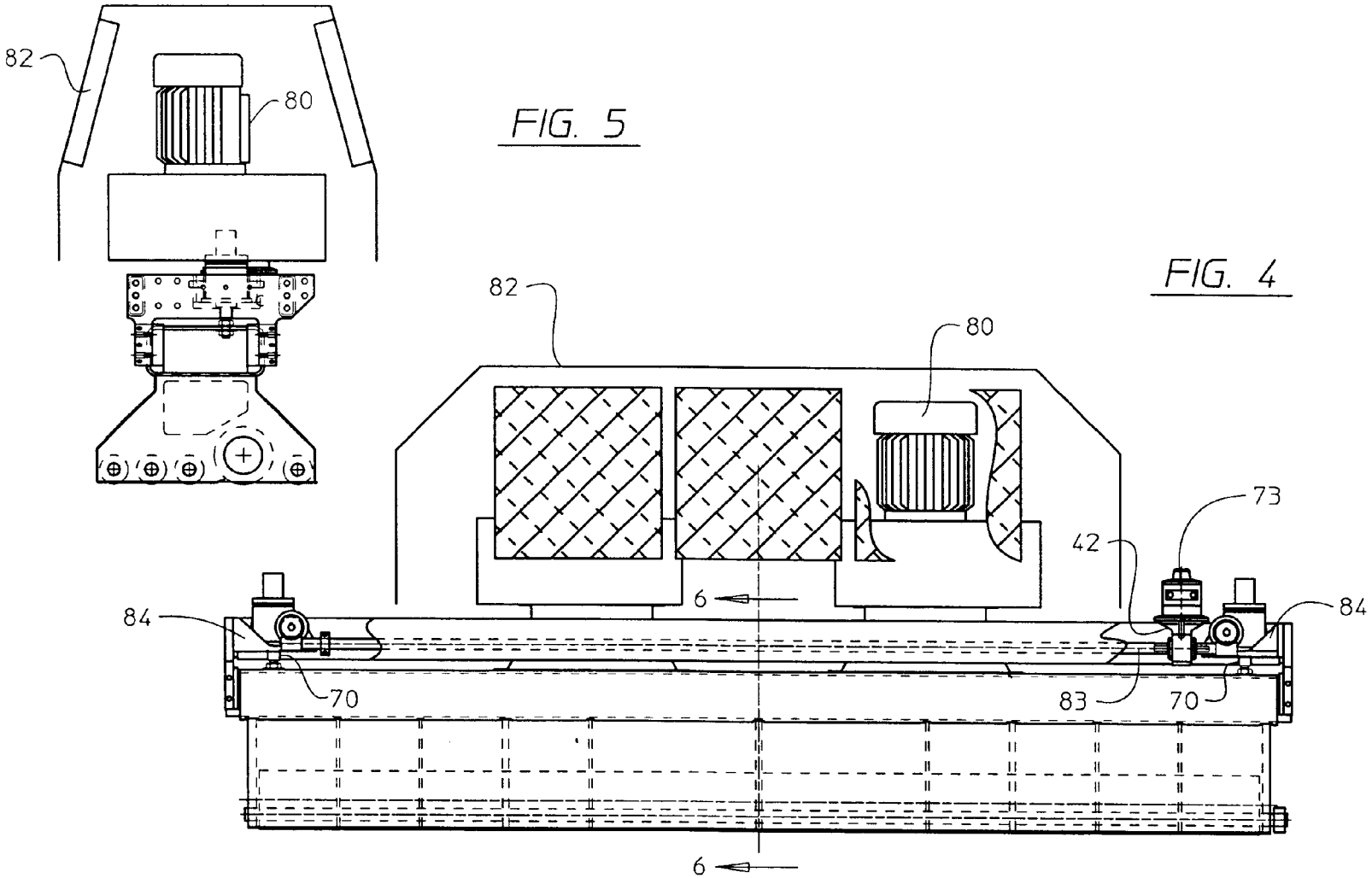
FIG. 4 is a side elevational view of a vacuum transfer machine embodying the present invention.
FIG. 5 is a side elevational view of the vacuum transfer machine of FIG. 4.
Figure 6:
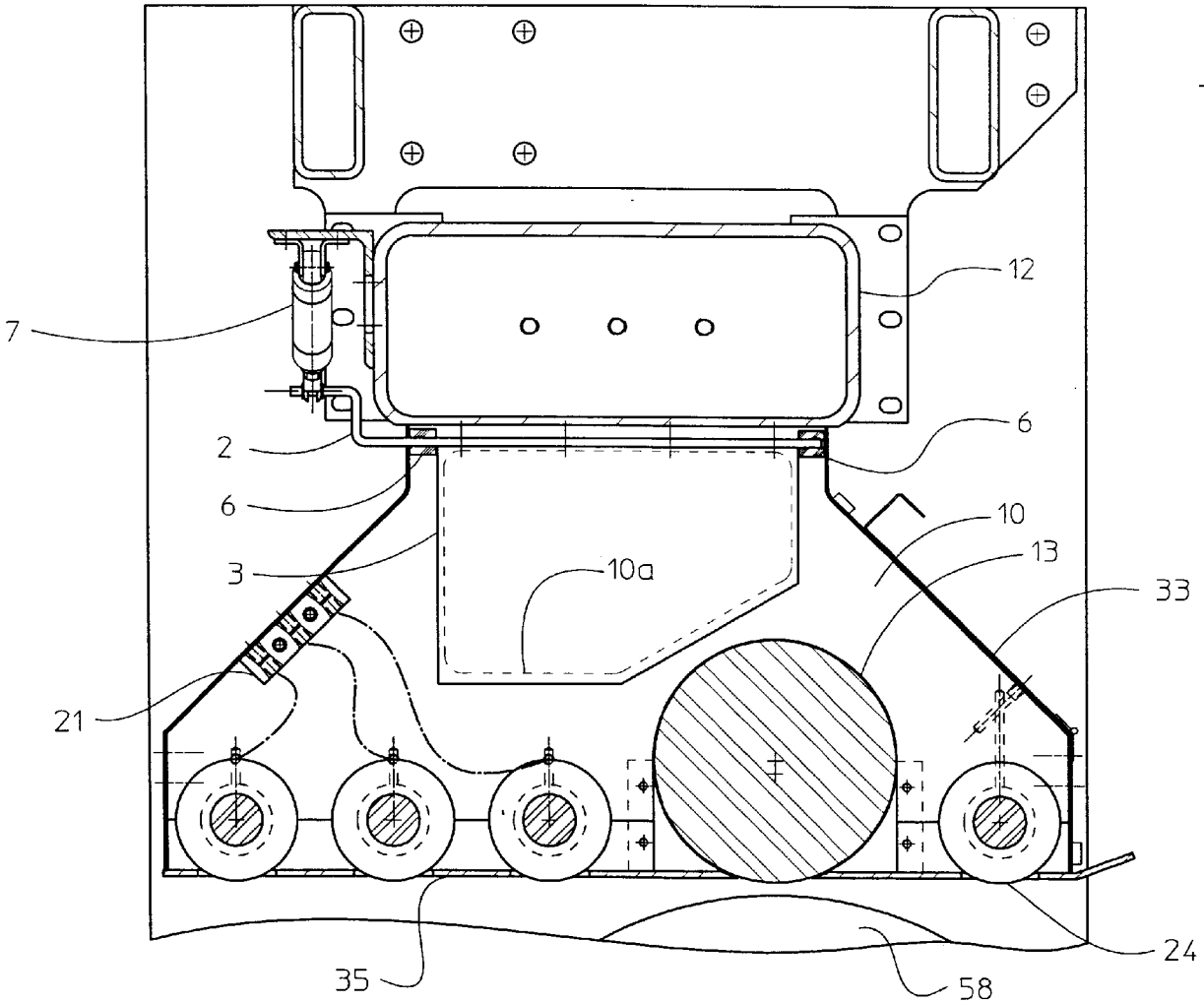
FIG. 6 is a cross-sectional view taken generally along lines 6—6 of FIG. 4.

In accordance with the present invention, the pull rolls 62 and their associated parts and drive are replaced by novel vacuum transfer machines, one being shown in FIGS. 4 and 5. In a box-making machine including only one printing unit, only a single vacuum transfer machine would be retrofitted into the machine. The vacuum transfer machine includes an impression cylinder 13 mounted in the opposite end walls of a vacuum chamber formed by a hood generally designated 33. Additionally included are a plurality of transport rolls or wheels 24. In the specific embodiment shown the transport rolls 24 and impression cylinder 13 extend through apertures in a plate 35 fixed to and in the bottom plane of the vacuum chamber. Transport wheels 24 contact the boards to transport them to the next printing station or to the die cutter 64. A grease header 21 for the transport wheels is shown in FIG. 6. The impression cylinder 13 transports the boards, and also of course functions to form the print impression to be applied to the boards.

Figure 7:
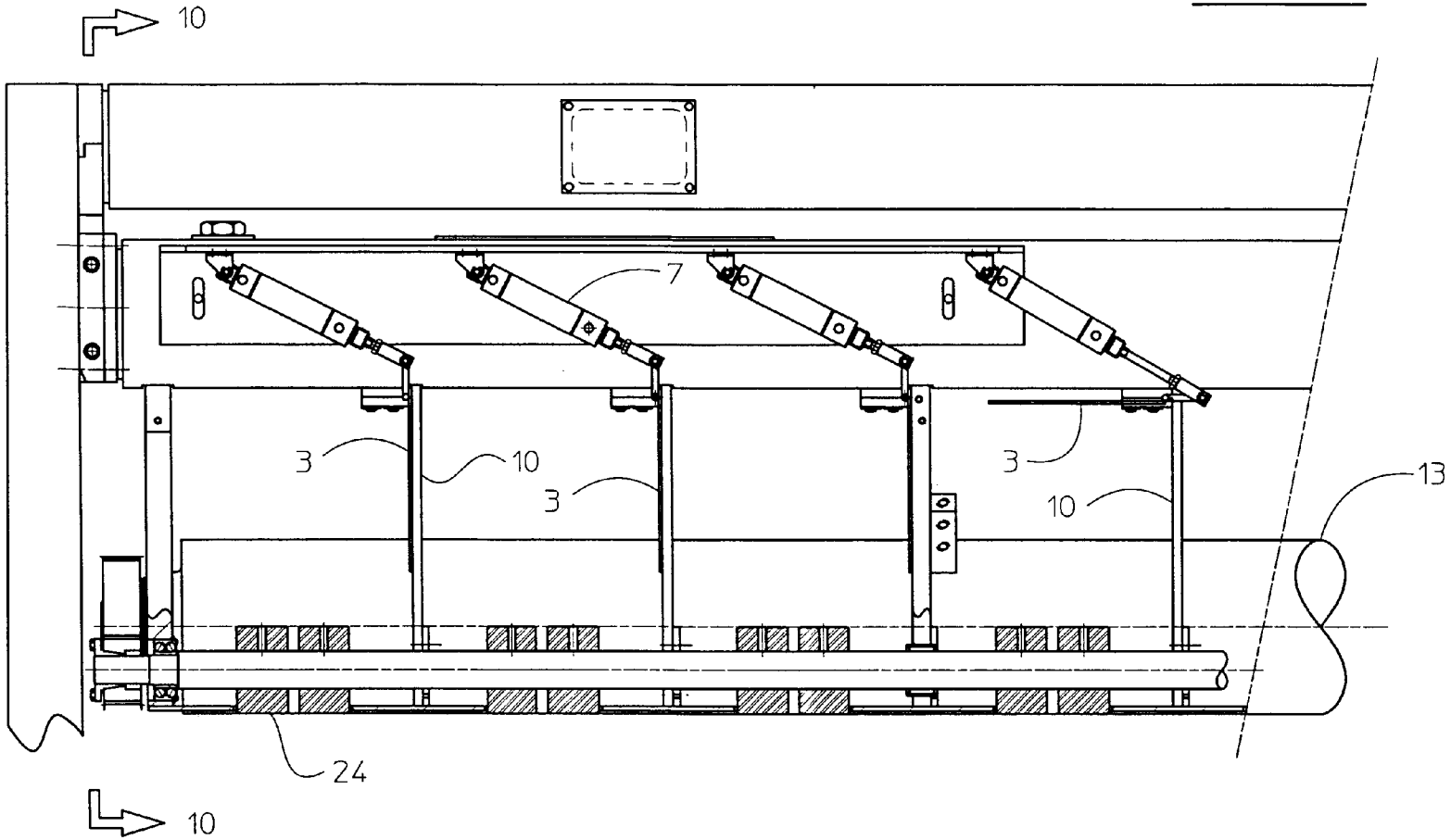
FIG. 7 is a fragmental side elevational view of the vacuum transfer machine (with parts removed) showing dampers for controlling the vacuum area in accordance with the size of the boards or blanks being handled by the box making machine.

Referring to FIGS. 6 and 7, in order to control the extent of the vacuum area needed to be applied to the boards, a plurality of doors or dampers 3 are mounted for movement in the vacuum chamber above the transport rolls and impression cylinder 13 at locations spaced along the length of the vacuum chamber. At these locations a plurality of partitions 10 extend transversely of the vacuum chamber. Partitions 10 have openings in them for communicating the areas on opposite sides thereof when the dampers 5 are in their open positions. FIG. 7 shows one such damper 3 in open position, while FIG. 6 shows a damper 3 in closed position closing the opening in the partition 10, the edge of the opening being shown by dotted lines 10*a*. In the preferred embodiment shown the dampers 3 are mounted for pivotal movement by pivot shaft 2 mounted in bearings 6 on opposite sides of the vacuum chamber as shown in FIG. 6. Any suitable actuator may be employed for rotating pivot shaft 2 such as the air cylinders 7 mounted on one side of a cross-tie 12 externally thereof as shown in FIGS. 6 and 7. Each damper 3 has its own actuator as shown in FIG. 7. Actuators 7 are operated and controlled through a computer so that the operator of the machine can change the size of the vacuum area in accordance with the size of the board or blank being handled. This allows the machine operator to set the vacuum doors without having to open the machine. Therefore the machine operator does not have to stop the machine and open it up to get access to the doors. The two benefits are time saving and safety because whenever an operator has to go inside a box-making machine, he has to go through a routine of locking and tagging-out to prevent another operator from trying to close and run the machine.

Figure 8:
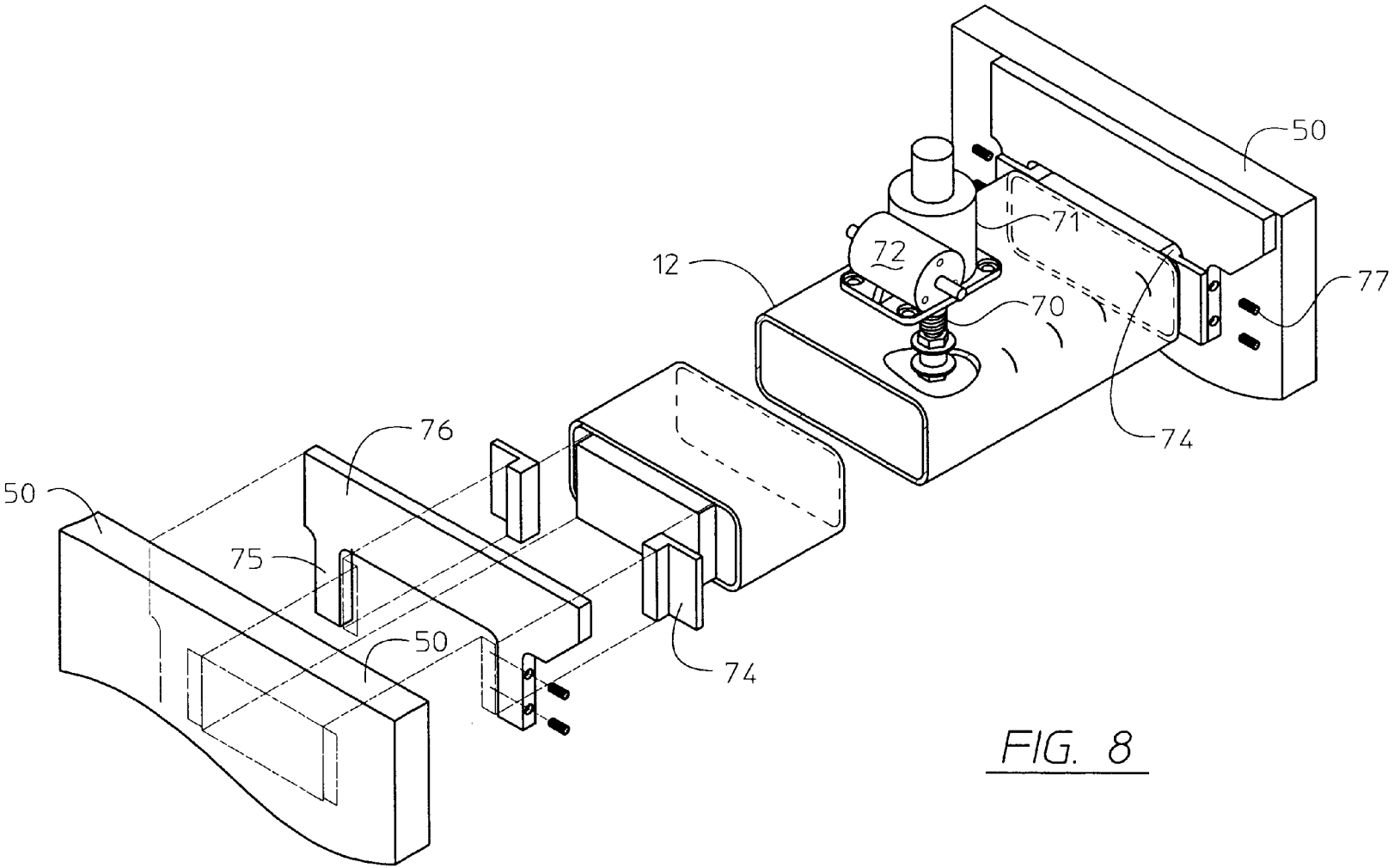
FIG. 8 is a perspective view with portions broken away illustrating a cross-tie included in the vacuum transfer machine for mounting it to the side frames of the box making machine.

Referring to FIGS. 4, 6 and 8, the frame of the vacuum chamber is fixed to and suspended from cross-tie 12. The latter is mounted to jack screws 70 that are rotatable by worm gears 71, 72 and a motor 73 to adjust the vertical position of the vacuum transfer machine. This adjustment is also used to set the printing nip and it can be set extremely accurately and with a digital readout. Motor 73 operates the jack screws 70 through a reducer 42 and a shaft 83. The jack screws 70 and associated motor and gears are mounted to frames 84 fixed to side frames 50. The opposite ends of the cross-ties 12 are provided with adjustment blocks 74 which are slidable along the legs of a T-frame 76 which is fixed to the side frames 50. Set screws 77 may be used to secure the adjustment blocks 74 to T-frame legs 75 once adjusted. The above-described adjustment mechanism is superior to those of the prior art which rely on precise machined holes in the heavy-duty frames of the box-making machine to control the "print impression nip". Inside these frame holes are geared eccentric bearing housings which are rotated to make nip adjustments. This arrangement becomes sloppy over time because the machined holes turn into worn out ovals after constant use. The result is the system develops "play"; therefore, the impression setting is no longer tight and precise. In contrast, the adjustment mechanism of the present invention does not rely on these existing frame holes to set and adjust the "print impression nip". This is a benefit for two reasons: one is that with the vacuum transfer machine of the present invention, these worn-out holes no longer need be repaired routinely because the holes' "roundness" no longer has any function in the nip setting; and the other is that the nip adjustment of the present invention eliminates the problem of "play" in the system because the unit moves only vertical and the device includes a method to remove "play" from the adjustment.

Figure 9:
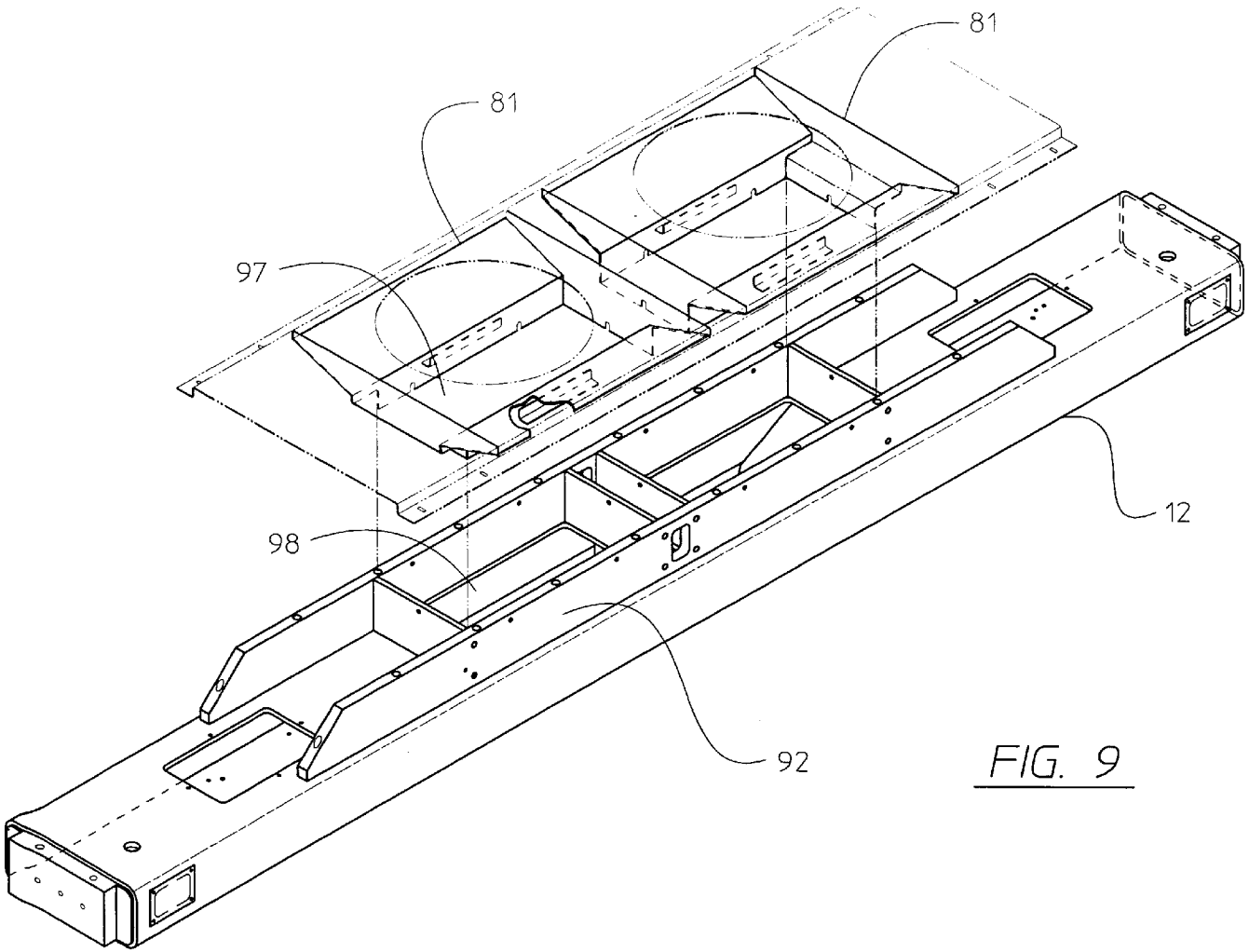
FIG. 9 is a view of the cross-tie of FIG. 8 with parts removed illustrating a mounting structure for blowers included in the vacuum transfer machine.

Referring now to FIGS. 4, 5 and 8, high performance blowers 80 are used for generating the vacuum in the vacuum chamber. In the preferred embodiment shown, blowers 80 are mounted on top of the machine through supports 81 mounted on a frame 92 fixed to the top of cross-tie 12. Blowers 80 communicate with the interior of the cross-tie 12 through the passages 97 and 98 shown in FIG. 9 and the interior of the cross-tie 12 communicates with the vacuum chamber to provide continuous vacuum at the impression cylinder 13 and transport wheels 24. Blowers 80 are "volume blowers" having a capacity dictated by the number of apertures in plate 35 required for a particular machine. In one embodiment two Cincinnati blowers HDBI-130 are used with 48 apertures. Thus, each aperture averages about 70 cubic feet of air per minute. The capacity of the blower(s) should provide no less than 50 cubic feet of air per minute for each aperture. Some of the vacuum transfer machines of the present invention will use one HDBI-150 blower, some will use one HDBI-160 blower, and others will use two HDBI-130 blowers. Blower selection will depend on the size of the machine that contains the vacuum transfer machine.

Referring to FIGS. 4 and 5, filters 82 are also provided through which to exhaust the air from the machine. The air is dispersed through the filters over a wide area so that the exhaust is clean and without strong currents. The filters 82 are provided on the top of the machine as shown. The capacity of the filters 82 is dictated by the capacity of the blowers. Enough filter area should be provided to limit the average velocity of exiting air to 200 feet per minute. In one embodiment, twenty-four square feet of filter area is used for each vacuum transfer machine.

Figure 10:
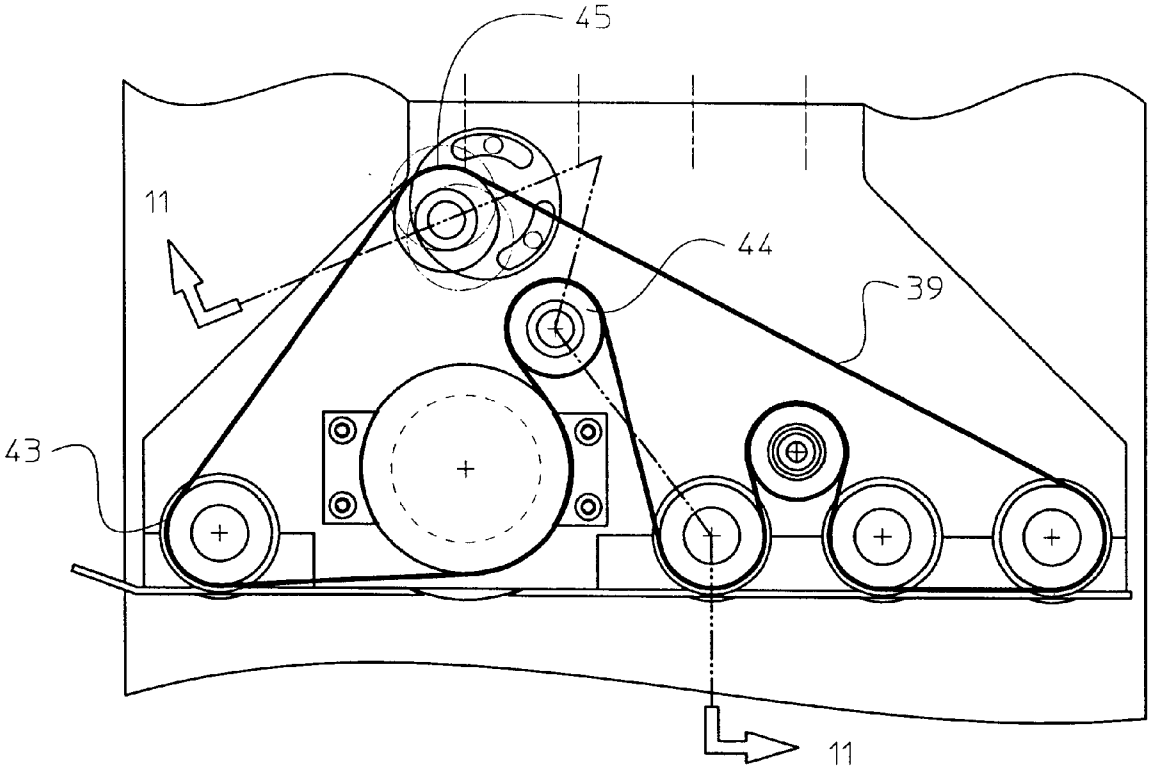
FIG. 10 is a view taken generally along lines 10—10 of FIG. 7.
Figure 11:
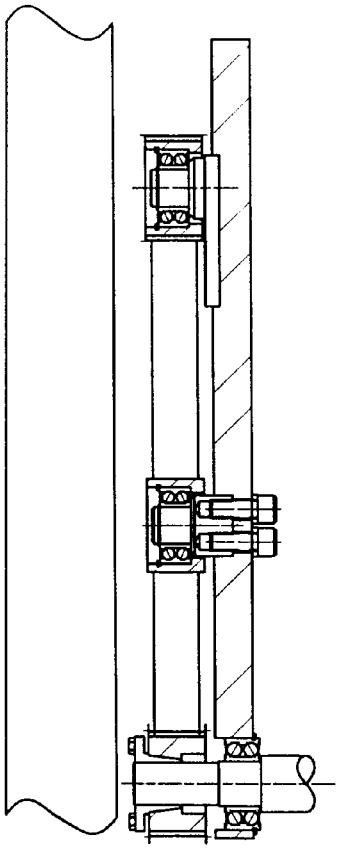
FIG. 11 is a view taken generally along lines 11—11 of FIG. 10.

Referring now to FIGS. 10 and 11, the drive transmission system for the transport wheels 24 and impression cylinder 13 is mounted externally on one end of the vacuum hood and includes, in the specific embodiment shown, pulleys 23T and 43 for driving the transport wheels and impression cylinder respectively. A pulley belt 39 is trained about the pulleys to drive them, and an eccentric tension pulley 45 is included for adjusting the tension in the pulley belt 39. An idler pulley 44 is also included in the drive train. Any suitable motor and gearing may be used to power the pulley system.

It will be seen from the above that the present invention provides a novel vacuum transfer machine that may be easily adapted for retrofit into various types of box-making machines to improve transport of the boards through the machine. In addition there is provided a unique method for retrofitting existing box-making machines to eliminate pull rolls and their associated disadvantages and replace them with an improved board transport machine.

Although specific versions and embodiments of the present inventions have been shown and described, it will be understood that the scope of the inventions are not limited to the specific embodiments but rather will be indicated in the claims to be appended in a complete application to be filed based on this application.

What is claimed is:

1. A vacuum transfer machine including in combination an enclosure defining a vacuum chamber, a plurality of transfer rolls extending along a direction and an impression cylinder mounted in the enclosure and vacuum chamber for rotation, a plurality of compartments in the vacuum chamber spaced along the transport rolls and impression cylinder, means for opening and closing said compartments, a blower mounted on the machine and communicating with said vacuum chamber for generating a vacuum therein, and a filter mounted on the machine for filtering exhaust air from the vacuum chamber.

2. The vacuum transfer machine defined in claim 1 wherein at least one of said transport rolls are mounted on one side of said impression cylinder and the remaining transport rolls are mounted on a side of the impression cylinder opposite said one side.

3. The vacuum transfer machine defined in claim 5 wherein said compartment includes a plurality of partitions spaced along the direction of said rolls and openings in said partitions, and wherein there is further included a plurality of halves for closing and opening said openings in the partitions respectively, and a plurality of actuators for moving said valves respectively between positions opening and closing said openings in said partitions.

4. The vacuum transfer machine defined in claim 3 further including a cross-tie for mounting said machine in a corrugated box making machine, said vacuum chamber being communicable with a vacuum passage in said cross-tie, and wherein said actuators are mounted on said cross-tie externally of said vacuum chamber.

5. The vacuum transfer machine defined in claim 4 wherein at least one of said transport rolls is mounted on one side of said impression cylinder and the remaining transport rolls are mounted on a side of the impression cylinder opposite said one side.

6. The vacuum transfer machine defined in claim 1 further including a cross-tie for mounting said machine in a corrugated box making machine, said vacuum chamber being communicable with a vacuum passage in said cross-tie.

7. The vacuum transfer machine defined in claim 6 wherein said blower and filter are mounted on said cross-tie.

8. The vacuum transfer machine defined in claim 6 wherein said cross-tie includes a first support for mounting the cross-tie to a frame of a box making machine, and a second support, and means mounting the second support to said first support for vertical adjustable movement for setting a nip of the impression cylinder.

9. The vacuum transfer machine defined in claim 1 wherein there is included in the vacuum chamber a horizontal generally planar member extending across the vacuum chamber, said planar member having apertures therein receiving portions of said transport rolls and impression cylinders, and wherein said blower is a pressure blower having a capacity no less than approximately fifty cubic feet of air per minute per aperture in said planar member.

10. The vacuum transfer machine defined in claim 9 wherein said filter has enough area to limit exiting air to 200 an average velocity of feet per minute.

11. A vacuum transfer machine for use in a box making machine, comprising in combination: an enclosure defining a vacuum chamber, said enclosure having a wall with a plurality of apertures in the wall, a plurality of transfer rolls mounted for rotation in the enclosure and projecting through said apertures for engaging and conveying a sheet being processed in a box making machine, a print impression cylinder mounted for rotation in the enclosure and projecting through one of said apertures, a support member fixed to the enclosure for holding and supporting the enclosure, said enclosure with its transfer rolls and impression cylinder and said support member being movable as a unit into a box making machine, and wherein said support member is adapted to be secured to opposite side frames of a box making machine.

12. The vacuum transfer machine defined in claim 11 wherein said support member includes a first part adapted to be fixed to side frames of a box making machine and a second part connected to said enclosure, and means for mounting said second part to said first part for vertical movement relative to said first part to enable adjustment of the impression cylinder.

13. The vacuum transfer machine defined in claim 12 further including a plurality of partitions in the vacuum chamber spaced along the transfer rolls and respectively having openings, a plurality of valves for closing and opening said openings in the partitions respectively and a plurality of actuators located on said support for operating said valves respectively.

14. The vacuum transfer machine defined in claim 12 including a blower mounted on said first part for generating a vacuum and a filter mounted on said first part for filtering exhaust from the vacuum chamber.

15. The vacuum transfer machine defined in claim 11 further including a plurality of partitions in the vacuum chamber spaced along the transfer rolls and respectively having openings, a plurality of valves for closing and opening said openings respectively and a plurality of actuators located on said support for operating said valves respectively.

16. The vacuum transfer machine defined in claim 15 including an electronic circuit including a computer for controlling operation of said actuators.

17. The vacuum transfer machine defined in claim 11 wherein said transfer rolls are located on opposite sides of said impression cylinder.

18. The transfer machine defined in claim 17 wherein: said support member includes a first part adapted to be fixed to side frames of a box making machine and a second part connected to said enclosure, and means for mounting said second part to said first part for vertical movement relative to said first part to enable adjustment of the position of the impression cylinder.

19. A vacuum transfer machine for use in a box-making machine, comprising in combination: an enclosure defining a vacuum chamber and having an aperture opening into the vacuum chamber, a print impression cylinder mounted for rotation in the enclosure and projecting through said aperture, a support member fixed to the enclosure for supporting the enclosure, and wherein said support member is adapted to be secured to a frame of a box-making machine and includes a first part adapted to be fixed to a frame of a box-making machine and a second part connected to said enclosure, and means for mounting said second part to said first part for vertical movement relative to said first part to enable adjustment of the impression cylinder.

20. A vacuum transfer machine for use in a box-making machine, comprising in combination: an enclosure defining a vacuum chamber and having an aperture opening into the vacuum chamber, a print impression cylinder mounted for rotation in the enclosure and projecting through said aperture, a plurality of partitions in the vacuum chamber spaced along the print impression cylinder and respectively having openings, a plurality of valves for closing and opening said partition openings respectively, a plurality of actuators located on said support for operating said valves respectively and an electronic circuit including a computer for controlling operation of said actuators.

* * * * *